US005173012A

United States Patent [19]

Ortwein et al.

[11] Patent Number: 5,173,012

[45] Date of Patent: Dec. 22, 1992

[54] GROUND-BORNE NOISE AND VIBRATION DAMPING

[75] Inventors: Hermann Ortwein, Köln; Heinz Fischer, Gelnhausen, both of Fed. Rep. of Germany

[73] Assignee: Clouth Gummiwerke Aktiengesellschaft, Köln, Fed. Rep. of Germany

[21] Appl. No.: 655,291

[22] Filed: Dec. 10, 1990

[51] Int. Cl.[5] ..... E02D 3/00; E02D 31/08

[52] U.S. Cl. ..... 405/258; 52/167 R; 238/283

[58] Field of Search ..... 405/258, 267, 303; 52/169.11, 167 R, 573, 396; 238/283, 306, 382

[56] References Cited

U.S. PATENT DOCUMENTS

| | | | |
|---|---|---|---|
| 1,728,736 | 9/1929 | Shergold | 52/167 |
| 2,719,676 | 10/1955 | Prater | 238/283 X |
| 3,526,071 | 9/1970 | Watanabe | 52/396 |
| 3,742,669 | 7/1973 | Mansfeld | 52/396 |
| 4,311,273 | 1/1982 | Marsh | 405/258 X |
| 4,484,423 | 11/1984 | McClure | 52/167 |
| 4,500,037 | 2/1985 | Braitsch et al. | 238/382 X |
| 4,647,258 | 3/1987 | Massarsch | 405/258 |
| 4,801,217 | 1/1989 | Goldberg | 405/258 X |
| 4,915,298 | 4/1990 | Ortwein | 238/283 |
| 5,042,211 | 8/1991 | Nestler | 52/573 X |

FOREIGN PATENT DOCUMENTS

| | | | |
|---|---|---|---|
| 0213925 | 12/1983 | Japan | 405/258 |
| 0235712 | 9/1989 | Japan | 405/258 |
| 797889 | 7/1958 | United Kingdom | 238/283 |

*Primary Examiner*—Dennis L. Taylor
*Attorney, Agent, or Firm*—Herbert Dubno

[57] ABSTRACT

A ground-borne noise and vibration damping system in which is a track bed formed with rails for a railway vehicle and generating noise and vibration, a structure is to be protected against the noise and vibration; and a damper for ground-borne noise and vibration is embedded vertically in the ground and interposed between the track bed and the structure. The damper has two upright rigid concrete plates defining a vertical gap between them, and an elastic mat sandwiched between the concrete plates and in contact therewith.

6 Claims, 4 Drawing Sheets

GROUND-BORNE NOISE AND VIBRATION DAMPING

FIELD OF THE INVENTION

The invention relates to protection of buildings against transmitted noise and against vibrations, which are caused by vehicles, especially rail vehicles. More particularly, this invention relates to a mat for damping ground-borne noise and vibration.

BACKGROUND OF THE INVENTION

In order to protect buildings against conducted noise and against vibration caused by rail vehicles, it is known to support the rails elastically, for example by means of elastic interlayers arrayed under the lower flanges of the rails. However, these elastic interlayers cause no damping or only insignificant damping of sound.

A significantly better effect is attained with rails laid upon solid ground by means of an elastic support which is arrayed between the rails and the solid ground, and in which the rails or the ties carrying the rails bear against a frame connected to the solid ground via obliquely positioned elastic interlayers. (DE-OS 28 28 713)

In the case of rails laid on ballast, a reduction of the conducted noise and vibration acting upon a nearby located building can be effected by an elastic mat located beneath the ballast (DE-PS 31 21 946; DE-OS 34 25 647).

OBJECT OF THE INVENTION

It is the object of the invention to create a ground-borne noise and vibration damper of the above mentioned type which is universally applicable and thus suitable for rails laid upon solid ground as well as on ballast, and also for the roadways for road vehicles.

SUMMARY OF THE INVENTION

This object is achieved with a damper made up of two rigid construction elements and an elastic mat arrayed therebetween and located between the buildings and the roadway or the track consisting of rails.

The mat utilized in the sense of the invention can be made of an elastic synthetic material. Suitably, this mat consists of rubber.

In the execution of the invention, the mat exhibits on at least one side a contoured hollow strip. Thereby—especially in the utilization of the arrangement according the invention tunnels—special drainage can be omitted.

According to the invention the mat is provided with at least one inserted cloth layer. At least one of the rigid construction elements can be a concrete plate. The mat and the rigid construction element delimiting it are essentially arrayed vertically and extend at least to the surface of the ground. Alternatively, the mat and the rigid construction elements are arrayed essentially horizontally below the roadway or below the plate carrying the track or the like.

The mat can be tub-shaped in cross section and the rigid construction elements delimiting the mat can be shaped accordingly. Moreover one of the rigid construction elements can be stationary and form the floor or the wall of a tunnel.

The upper rigid construction elements can be fabricated in place with the mat serving as a temporary concrete form. The outer gaps between the two rigid constriction elements can be made watertight by means of a contoured gasket made of an elastic material. At least for one of the rigid elements, on the edge areas contoured strips of metal or synthetic material are provided, which are inserted into the gasket. The contoured strips can have protrusions facing inward which engage corresponding recesses of the gasket.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
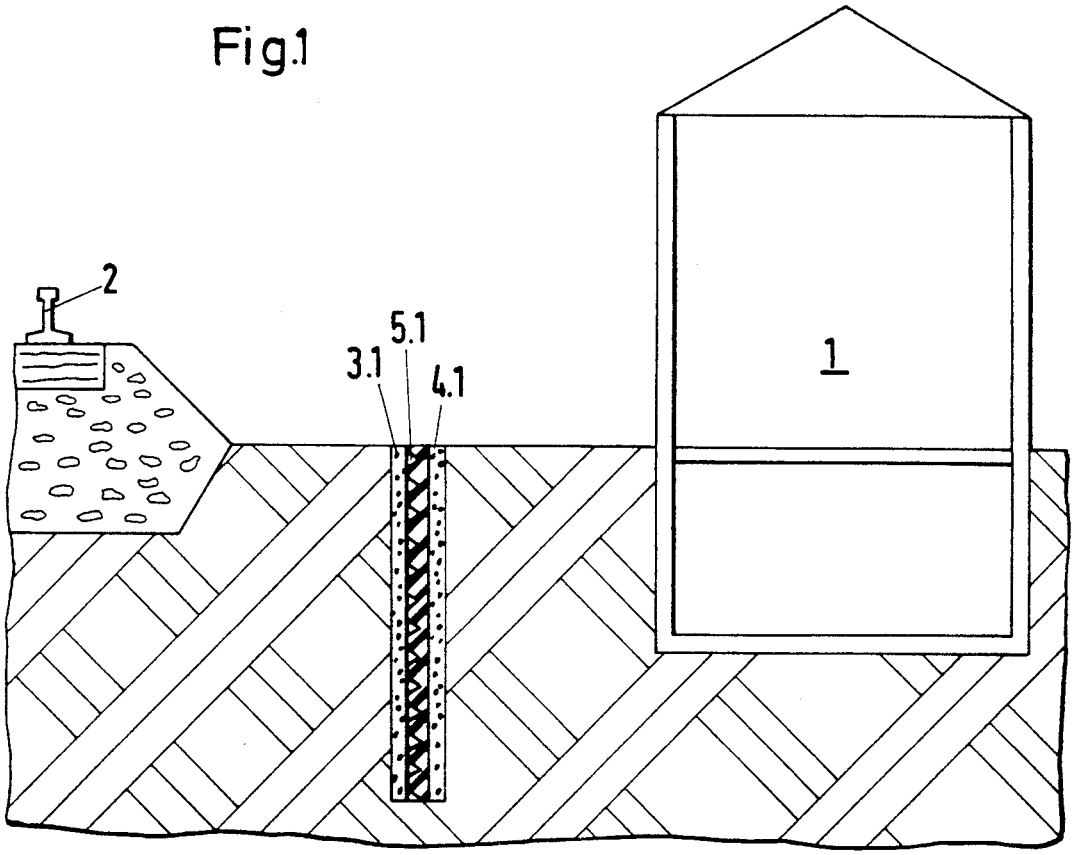
FIG. 1 is a cross sectional view diagrammatically showing a damper; arrangement vertically emplaced between a building and a track.

In the embodiment of FIG. 1, an arrangement according to the invention consisting of concrete plates 3.1 and 4.1 as well as a mat 5.1 is emplaced vertically between a building 1 and a track consisting of two rails 2. This damper extends considerably below the foundation of the building 1 and extends upward to the ground surface.

Figure 2:
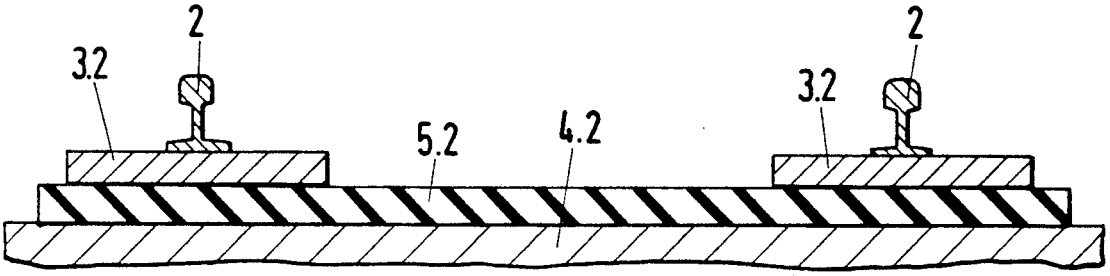
FIG. 2 is a section through a horizontally oriented arrangement in which one of the rigid construction elements is formed by two ties running under the rails in the longitudinal direction of the rails.

The embodiment of FIG. 2 consists of a mat 5.2 and two ties 3.2 running in the longitudinal direction of the rails 2.2 and a stationary rigid plate 4.2, which can consist e.g. of concrete. The ties 3.2 constitute rigid plates which, together with the plate 4.2 sandwich the mat 5.2 between them.

Figure 3:
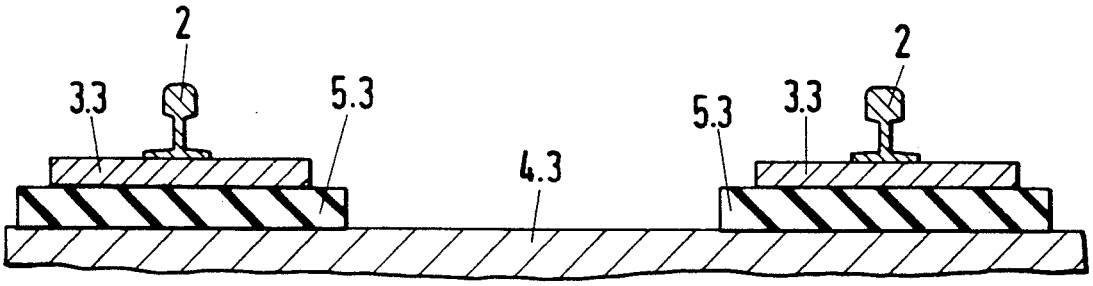
FIG. 3 a different horizontally oriented arrangement, where one of the rigid construction elements is likewise formed by two ties and where the mat is also made in two parts, where the two ties as well as the two sections of the mat extend in the longitudinal direction of the rails.

An arrangement is shown in FIG. 3 which consists of a two-piece mat 5.3, two ties 3.3. and a stationary rigid plate 4.3, where the two parts of the mat 5.3 as well as the ties 3.3 run in the longitudinal directions of the rails 2.3.

Figure 4:
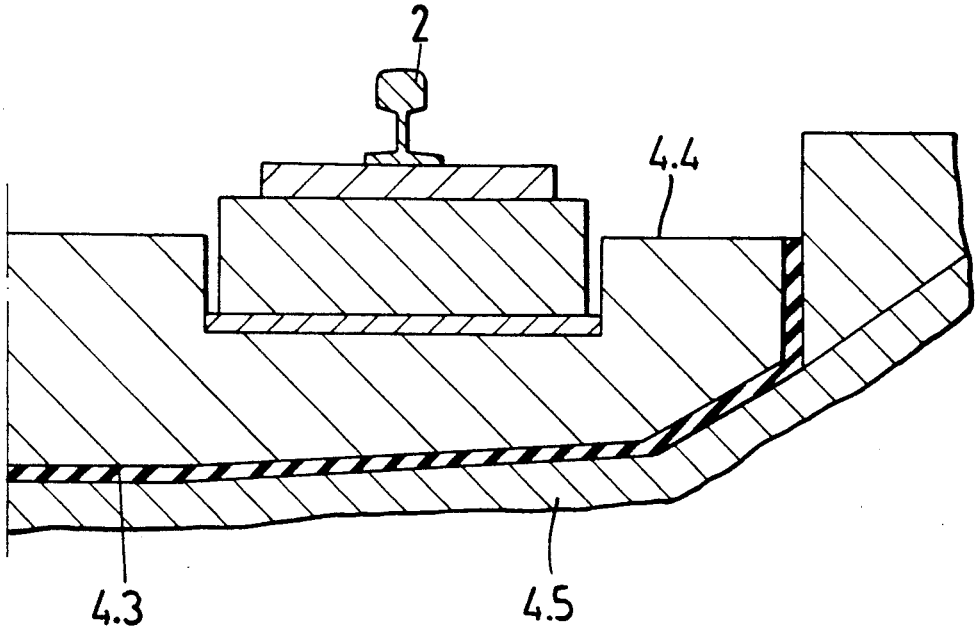
FIG. 4 is a cross sectional view through an arrangement where the mat is made in tub-shaped cross section, and the rigid construction elements abutting on the mat are shaped accordingly.

FIG. 4 shows an embodiment wherein the damper of the invention has a mat 4.3 tub-shaped in cross section, which is arrayed between suitably shaped stationary plates 4.4, 4.5. The upper plate 4.4 may be fabricated on location.

Figure 5:
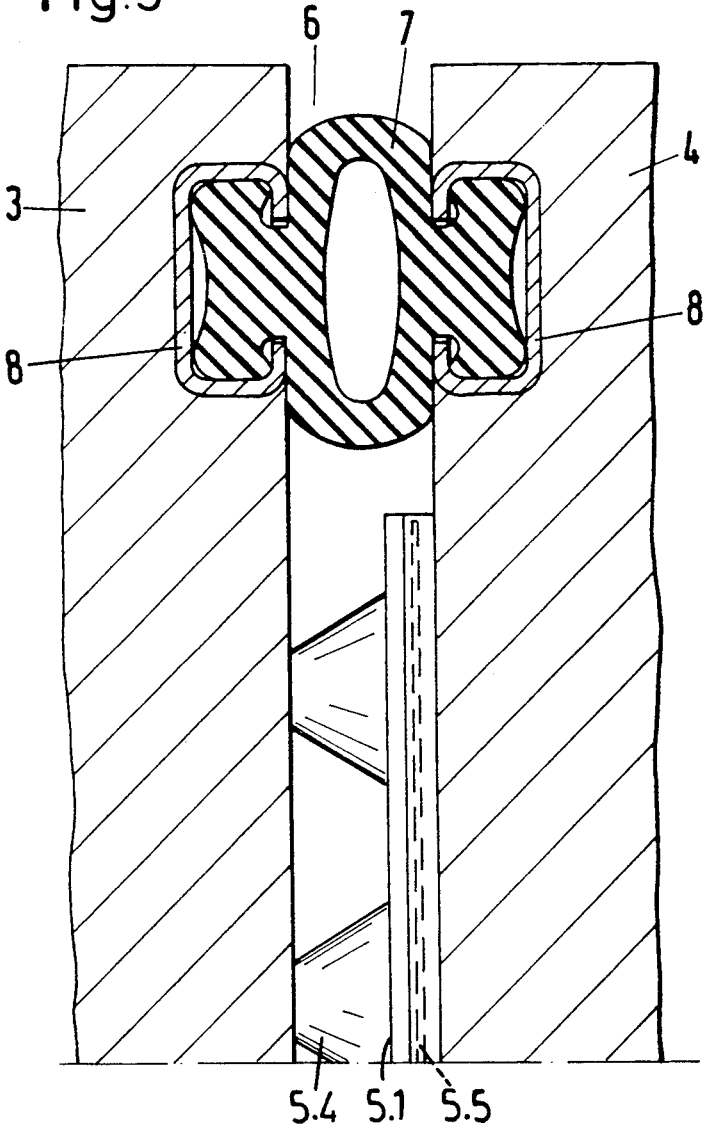
FIG. 5 is section showing the outer gap of an arrangement with a contoured gasket emplaced therein.
Figure 6:
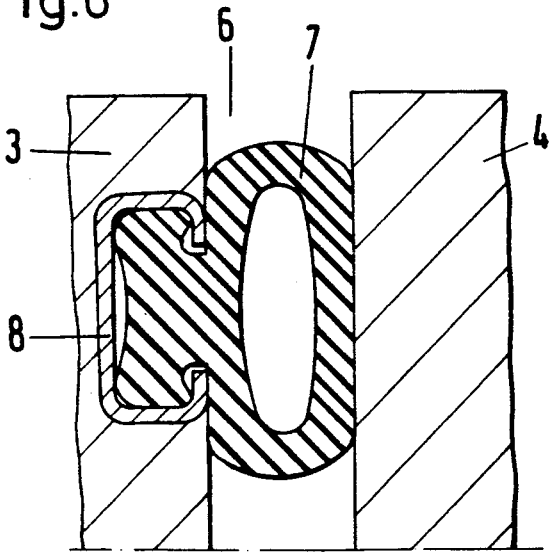
FIG. 6 is a section through the gap shown in FIG. 5 with a different gasket emplaced therein.

As can be seen from FIGS. 5 and 6, a gasket can be emplaced between the two rigid construction elements 3 and 4 according to the invention in order to close the gap in a watertight manner. In the example of execution according to FIG. 5, in the edge section of both rigid construction elements 3 and 4, one each contoured strip 8 is emplaced, into which is inserted the contoured gasket 7; in the example of execution according to FIG. 6, only one such strip 8 is provided in the edge section of the rigid construction element 3. The mat 5.1 has protrusions 5.4 forming contouring on one side and can have a fabric layer 5.5 inlaid therein.

We claim:

1. A ground-borne noise and vibration damping system comprising:

a track bed formed with rails for a railway vehicle and generating noise and vibration;

a structure to be protected against said noise and vibration; and a damper for ground-borne noise and vibration embedded vertically in the ground and interposed between said track bed and said structure, said damper comprising:

two upright rigid concrete plates defining a vertical gap between them, and a rubber mat sandwiched between said concrete plates and in contact therewith, said concrete plates extending substantially to the surface of the ground in which said damper is embedded, a textile layer being inlaid in said mat.

2. A ground-borne noise and vibration damping system comprising:

a track bed formed with rails for a railway vehicle and generating noise and vibration;

a structure to be protected against said noise and vibration;

a damper for ground-borne noise and vibration embedded vertically in the ground and interposed between said track bed and said structure, said damper comprising:

two upright rigid concrete plates defining a vertical gap between them, and an elastic mat sandwiched between said concrete plates and in contact therewith; and a channel formed along an edge of one of said plates opening toward the other of said plates, and a contoured gasket received in said channel and bridging said gap.

3. The ground-borne noise and vibration damping system defined in claim 2 wherein each of said plates is formed with a respective channel and said gasket extends into both of said channels.

4. The ground-borne noise and vibration damping system defined in claim 2 wherein said channels are lined with respective contoured strips.

5. The ground-borne noise and vibration damping system defined in claim 2 wherein said mat is formed on one side with a contoured surface engaging one of said plates.

6. The ground-borne noise and vibration damping system comprising:

a track bed formed with rails and a rail support; and a damper for ground-borne noise and vibration beneath said bed and comprising:

a lower concrete plate having an upwardly-extending portion outwardly of said bed, a tub-shaped elastic mat lining said lower concrete plate, and an upper concrete plate cast in situ on said mat and supporting said bed, said concrete plates sandwiching said mat between them.

* * * * *